US008876502B2

(12) United States Patent
Usui et al.

(10) Patent No.: US 8,876,502 B2
(45) Date of Patent: Nov. 4, 2014

(54) MECHANISM FOR RESTRAINING FUEL PRESSURE PULSATION AND HIGH PRESSURE FUEL SUPPLY PUMP OF INTERNAL COMBUSTION ENGINE WITH SUCH MECHANISM

(71) Applicant: Hitachi, Ltd., Tokyo (JP)

(72) Inventors: Satoshi Usui, Hitachinaka (JP); Shingo Tamura, Hitachinaka (JP); Katsumi Miyazaki, Hitachinaka (JP); Sunao Takahashi, Hitachinaka (JP); Masayuki Suganami, Iwaki (JP); Minoru Hashida, Hitachinaka (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 13/754,932

(22) Filed: Jan. 31, 2013

(65) Prior Publication Data

US 2013/0149177 A1 Jun. 13, 2013

Related U.S. Application Data

(63) Continuation of application No. 12/428,967, filed on Apr. 23, 2009, now Pat. No. 8,393,881.

(30) Foreign Application Priority Data

Apr. 25, 2008 (JP) ..... 2008-114758

(51) Int. Cl.

| | |
|---|---|
| ***F04B 11/00*** | (2006.01) |
| ***F04B 19/00*** | (2006.01) |
| ***F02M 55/04*** | (2006.01) |
| ***F02M 59/48*** | (2006.01) |

(52) U.S. Cl.

CPC ..... *F04B 19/00* (2013.01); *F02M 55/04* (2013.01); *F02M 59/48* (2013.01)

USPC ..... 417/540

(58) Field of Classification Search

USPC ..... 417/540, 542

See application file for complete search history.

(56) References Cited

U.S. PATENT DOCUMENTS

| | | | |
|---|---|---|---|
| 4,507,063 | A | 3/1985 | Kemmner et al. |
| 4,649,884 | A | 3/1987 | Tuckey |
| 4,660,524 | A | 4/1987 | Bertsch et al. |
| 5,617,827 | A | 4/1997 | Eshleman et al. |
| 5,794,594 | A | 8/1998 | Fehlmann |

(Continued)

FOREIGN PATENT DOCUMENTS

| | | | |
|---|---|---|---|
| DE | 103 45 725 | A1 | 4/2005 |
| EP | 1 411 236 | A2 | 4/2004 |

(Continued)

OTHER PUBLICATIONS

European Search Report dated Oct. 14, 2009 (seven (7) pages).

(Continued)

*Primary Examiner* — Bryan Lettman

(74) *Attorney, Agent, or Firm* — Crowell & Moring LLP

(57) ABSTRACT

A mechanism for reducing pressure pulsation includes a pair of metal dampers formed by joining two disk-shaped metal diaphragms over an entire circumference and forming a hermetically sealed space inside a joined portion. Gas is sealed in the aforementioned hermetically sealed space of the damper, and a pair of pressing members give pressing forces to both outer surfaces of the aforementioned metal dampers at a position at an inner diameter side from the joined portion. The mechanism is unitized, with the pair of pressing members being connected in a state in which they sandwich the metal damper.

9 Claims, 13 Drawing Sheets

(56) References Cited

U.S. PATENT DOCUMENTS

| | | | | |
|---|---|---|---|---|
| 6,059,547 | A | 5/2000 | Konishi et al. | |
| 6,135,734 | A | 10/2000 | Isozumi et al. | |
| 6,604,612 | B2 | 8/2003 | Nagy et al. | |
| 6,901,964 | B2 | 6/2005 | Kippe et al. | |
| 7,124,738 | B2 * | 10/2006 | Usui et al. | 123/446 |
| 7,165,534 | B2 | 1/2007 | Usui et al. | |
| 7,401,594 | B2 | 7/2008 | Usui et al. | |
| 7,513,240 | B2 | 4/2009 | Usui et al. | |
| 2007/0107698 | A1 | 5/2007 | Usui et al. | |
| 2008/0289713 | A1 | 11/2008 | Munakata et al. | |

FOREIGN PATENT DOCUMENTS

| | | | | |
|---|---|---|---|---|
| EP | 1 411 236 | B1 | 4/2004 | |
| EP | 1 731 761 | A1 | 12/2006 | |
| EP | 1 775 459 | A1 | 4/2007 | |
| JP | 2003-254191 | A | 9/2003 | |
| JP | 2004-138071 | A | 5/2004 | |
| JP | 2005-42554 | A | 2/2006 | |
| JP | 2006-521487 | A | 9/2006 | |
| JP | 2006521487 | * | 9/2006 | F02M 37/00 |
| WO | WO 84/00797 | A1 | 3/1984 | |

OTHER PUBLICATIONS

L. E. Hulbert et al., "State-of-the-Art Survey of Metallic Bellows and Diaphragms for Aerospace Applications," Technical Report No. AFRPL-TR-65-215, Nov. 1965 (Ten (10) pages).

Mario Di Giovanni, "Flat and Corrugated Diaphragm Design Handbook," 1982, CRC Press, Boca Raton (Five (5) pages).

* cited by examiner (1) - - - - - - - - > INTAKE PASSAGE 10c → PRESSURE CHAMBER 11

(2) ..... > INTAKE PASSAGE 10c → SEAL CHAMBER 10f (3) ———— > INTAKE PORT 10a→INTAKE PASSAGE 10b→INTAKE PASSAGE 10c (3) = (1) + (2)

(1) - - - - - - - - > INTAKE PASSAGE 10d → PRESSURE CHAMBER 11

(2) ····· > INTAKE PASSAGE 10d → SEAL CHAMBER 10f (3) ——— > INTAKE PORT 10a→INTAKE PASSAGE 10b→INTAKE PASSAGE 10d (3) = (1) + (2)

MECHANISM FOR RESTRAINING FUEL PRESSURE PULSATION AND HIGH PRESSURE FUEL SUPPLY PUMP OF INTERNAL COMBUSTION ENGINE WITH SUCH MECHANISM

CROSS REFERENCE TO RELATED APPLICATIONS

This application is a continuation of U.S. patent application Ser. No. 12/428,967, filed Apr. 23, 2009, the entire disclosure of which is incorporated herein by reference, the priority of which is claimed, and claims priority under 35 U.S.C. §119 to Japanese Patent Application No. 2008-114758, filed Apr. 25, 2008.

TECHNICAL FIELD

The present invention relates to a mechanism for reducing pressure pulsation which is housed in a damper chamber provided in a low pressure fuel passage leading to a pressure chamber of a high pressure fuel supply pump.

Further, the present invention also relates to a high pressure fuel supply pump of an internal combustion engine integrally including such a mechanism for reducing pressure pulsation.

BACKGROUND ART

A conventional mechanism for reducing fuel pressure pulsation is configured to hold a metal damper which is formed by joining two metal diaphragms and sealing gas inside the two metal diaphragms, between a damper chamber provided in a pump main body and a cover fitted onto the main body, and is housed in the damper chamber formed in a low pressure fuel passage leading to a pressure chamber of a high pressure fuel supply pump.

More specifically, two metal diaphragms are welded at their outer peripheries, have a disk-shaped convex portion with gas sealed in a center, and include an annular flat plate portion in which the two metal diaphragms are superimposed on each other, between the weld portion at the outer periphery and the disk-shaped convex portion. There are known a damper mechanism in which both outer surfaces of the flat plate portion are held by thick portions provided at a cover and a main body, or a damper mechanism in which elastic members are sandwiched between the cover and the annular flat plate portion and between the main body and the annular flat portion to hold them.

Further, there are known high pressure fuel supply pumps including such mechanisms for reducing fuel pressure pulsation (see JPA-2004-138071, JP-A-2006-521487, JP-A-2003-254191 and JP-A-2005-42554).

[Patent Document 1] JP-A-2004-138071
[Patent Document 2] JP-A-2006-521487
[Patent Document 3] JP-A-2003-254191
[Patent Document 4] JP-A-2005-42554

DISCLOSURE OF INVENTION

Problem to be Solved by the Invention

In the above described prior art, at the process of assembly operation of a metal damper configured by metal diaphragms, as a damper mechanism for reducing pressure pulsation, into a low pressure fuel passage and a high pressure fuel supply pump, a number of components need to be installed and fixed into a body at the same time, and there arises the problem of easily causing component omission and assembly error.

An object of the present invention is to reduce the number of components at the time of operation of installing a metal diaphragm damper as a damper mechanism for reducing pressure pulsation into a low pressure fuel passage and prevent component omission and assembly error.

Further, an object of the present invention is to reduce the number of components at the time of assembling a damper mechanism for reducing pressure pulsation to a high pressure fuel supply pump, and prevent component omission and assembly error in the high pressure fuel supply pump including the damper mechanism for reducing pressure pulsation.

Means for Solving the Problem

A damper mechanism for reducing pressure pulsation includes a metal damper in which two disk-shaped metal diaphragms are joined over an entire circumference and a hermetically sealed space is formed inside a joined portion, with gas being sealed in the aforementioned hermetically sealed space of the damper, has a pair of pressing members which give pressing forces respectively to both outer surfaces of the aforementioned metal damper at a position at an inner diameter side from the joined portion, and is unitized with the pair of pressing members connected in a state sandwiching the metal damper.

Advantages of the Invention

According to the invention characterized by the above mentioned features, component omission and assembly error can be prevented by reducing the number of components which are installed or fixed into a body at the same time at a time of operation of installing a metal diaphragm damper as a damper mechanism for reducing pressure pulsation in a low pressure fuel passage or a high pressure fuel supply pump.

The other objects, characteristics and advantages of the present invention will become apparent from the following description of embodiments of the present invention relating to the accompanying drawings.

BEST MODE FOR CARRYING OUT THE INVENTION

Hereinafter, embodiments of the present invention will be described with use of the drawings.

Embodiment 1

A first embodiment of the present invention will be described.

First, based on FIGS. 1 to 3, a basic operation of a high pressure fuel supply pump will be described.

Figure 1:
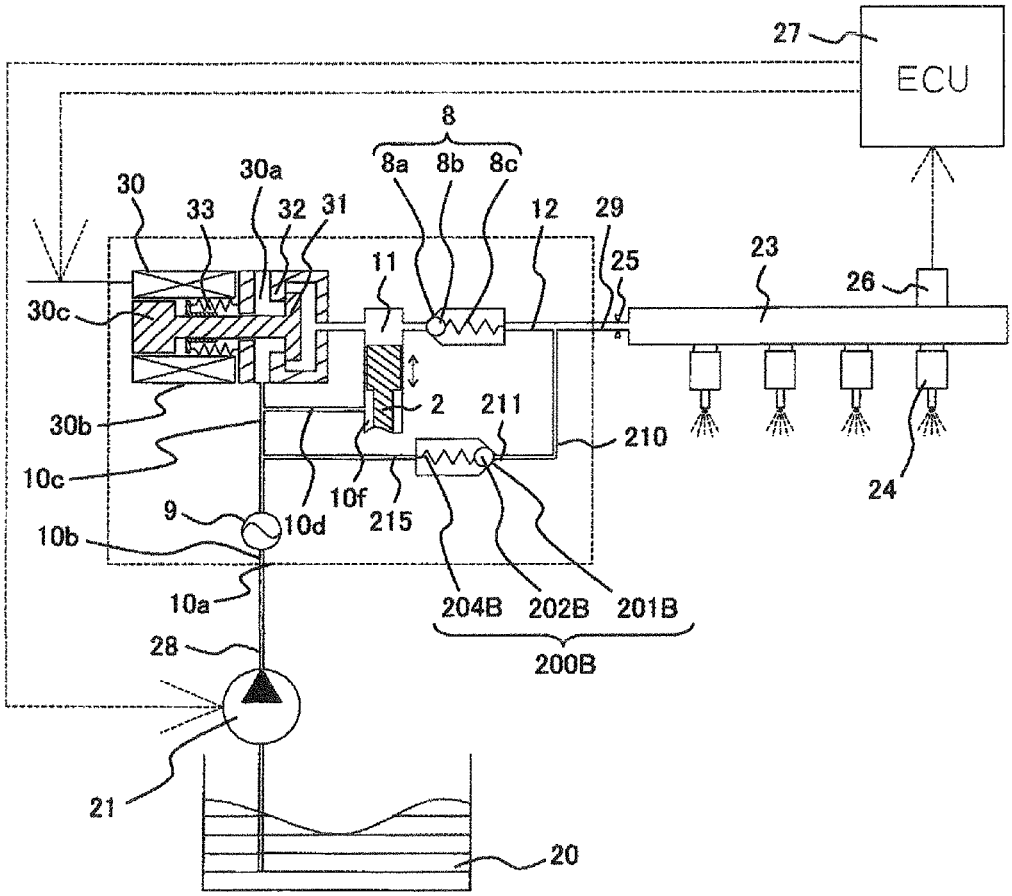
FIG. 1 is one example of a fuel supply system using a high pressure fuel supply pump according to a first embodiment in which the present invention is carried out.

FIG. 1 shows a fuel supply system including a high pressure fuel supply pump.

Figure 2:
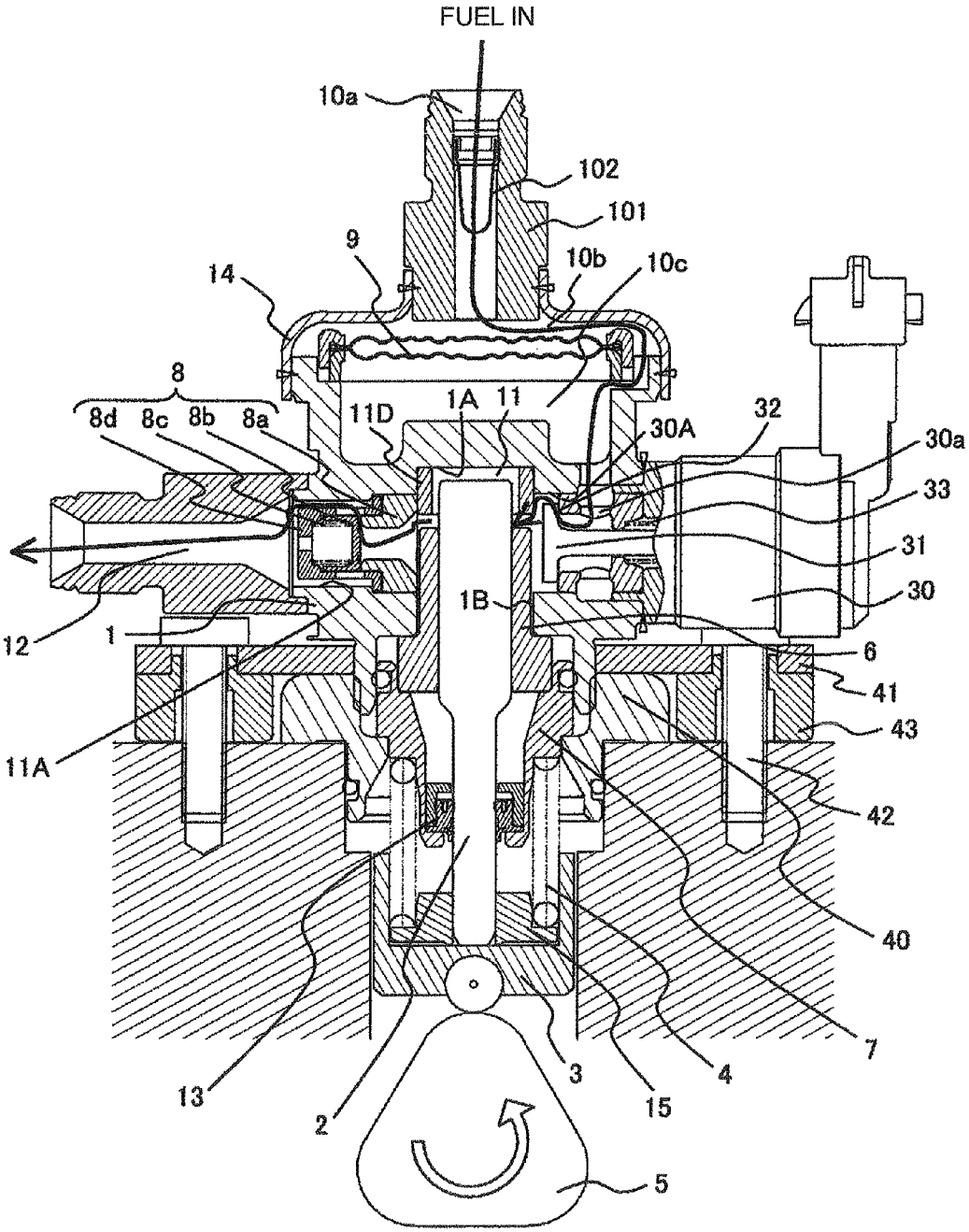
FIG. 2 is a vertical sectional view of the high pressure fuel supply pump according to the first embodiment in which the present invention is carried out.

FIG. 2 shows a vertical sectional view of the high pressure fuel supply pump.

Figure 3:
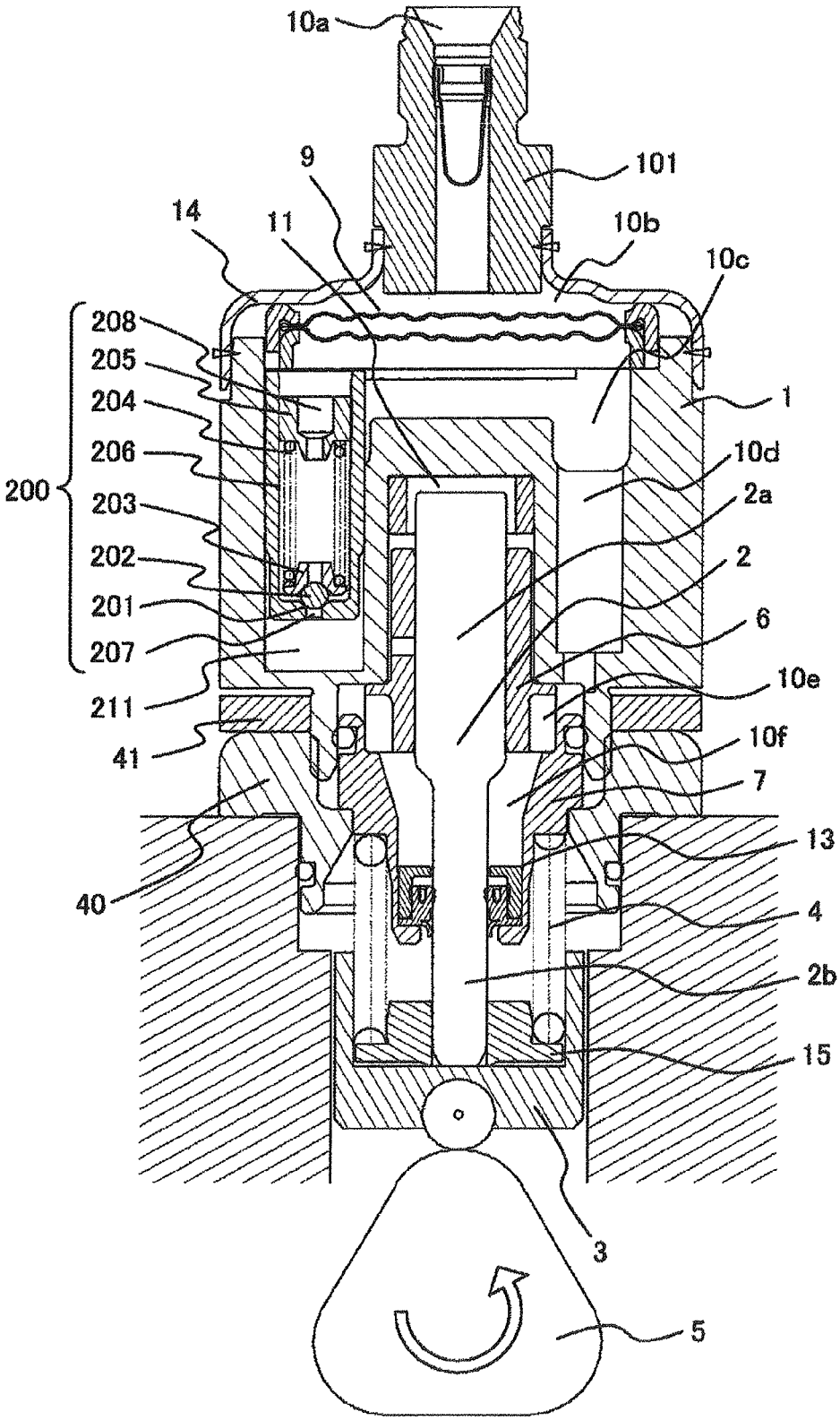
FIG. 3 shows a vertical sectional view of the high pressure fuel supply pump according to the first embodiment in which the present invention is carried out, and shows a vertical sectional view of the position of FIG. 2 which is rotated by 90°.

FIG. 3 shows a vertical sectional view in a direction perpendicular to FIG. 2.

In FIG. 1, the part enclosed by the broken line shows a pump housing 1 of a high pressure pump, and shows that a damper mechanism and components shown inside the broken line are integrally installed in the pump housing 1 of the high pressure pump.

A fuel of a fuel tank 20 is pumped up by a feed pump 21 based on a signal from an engine control unit 27 (hereinafter, called an ECU), and pressurized to a suitable feed pressure to be fed to a intake port 10*a* of the high pressure fuel supply pump through a intake pipe 28.

The fuel passing through the intake port 10*a* passes through a filter 102 fixed inside a intake joint 101, and further through a metal diaphragm damper 9, and intake passages 10*b* and 10*c* to reach a intake port 30*a* of an electromagnetic intake valve mechanism 30 configuring a variable fuel discharge amount control mechanism.

The intake filter 102 in the intake joint 101 has the function of preventing foreign matters existing in the area from the fuel tank 20 to the intake port 10*a* from being absorbed into a high pressure fuel supply pump by flow of a fuel.

The details of the metal diaphragm damper 9 for reducing pressure pulsation will be described later.

The electromagnetic intake valve mechanism 30 includes an electromagnetic coil 30*b*, and in the state in which the electromagnetic coil 30*b* is energized, the state in which a spring 33 is compressed is kept with an electromagnetic plunger 30*c* being moved rightward in FIG. 1.

At this time, a intake valve member 31 mounted to a tip end of the electromagnetic plunger 30*c* opens a intake port 32 connecting to a pressure chamber 11 of the high pressure pump.

When the electromagnetic coil 30*b* is not energized, and fluid differential pressure does not exist between the intake passage 10*c* (intake port 30*a*) and the pressure chamber 11, the intake valve member 31 is acted in a valve closing direction by the biasing force of the spring 33, and the intake port 32 is in a closed state.

When a plunger 2 is in a intake process in which it displaces downward in FIG. 2 by rotation of a cam which will be described later, the volume of the pressure chamber 11 increases, and the fuel pressure in the pressure chamber 11 reduces. When the fuel pressure in the pressure chamber 11 becomes lower than the pressure of the intake passage 10*c* (intake port 30*a*) in this process, a valve opening force (force to displace the intake valve member 31 rightward in FIG. 1) by a fluid pressure difference of the fuel occurs to the intake valve member 31.

The intake valve member 31 is overcome the biasing force of the spring 33, and open the intake port 32, by valve opening force due to the fluid pressure difference.

When a control signal from the ECU 27 is applied to the electromagnetic intake valve mechanism 30 in this state, an electric current flows into the electromagnetic coil 30*b* of the electromagnetic intake valve mechanism 30, the electromagnetic plunger 30*c* moves rightward in FIG. 1 by the magnetic biasing force which occurs by this, and the spring 33 is kept in the compressed state. As a result, the state in which the intake valve member 31 opens the intake port 32 is kept.

When the plunger 2 finishes the intake process while keeping the application state of the input voltage to the electromagnetic intake valve mechanism 30, and the plunger 2 moves to the compression process in which it displaces upward in FIG. 2, the intake valve member 31 is still kept open since the magnetic biasing force remains to be kept.

The volume of the pressure chamber 11 decreases with compression movement of the plunger 2, but in this state, the fuel which is once sucked into the pressure chamber 11 is spilled to the intake passage 10*c* (intake port 30*a*) through the intake valve member 31 in the valve open state again, and therefore, the pressure of the pressure chamber does not rise. This process is called a spill process.

When the control signal from the ECU 27 is cleared in this state, and energization to the electromagnetic coil 30*b* is shut off, the magnetic biasing force acting on the electromagnetic plunger 30*c* is erased after a lapse of a specified time (after the lapse of magnetic and mechanical delay time). The biasing force by the spring 33 works on the intake valve member 31, and therefore, when the magnetic force acting on the electromagnetic plunger 30*c* disappears, the intake valve member 31 closes the intake port 32 by the biasing force by the spring 33.

When the intake port 32 is closed, the fuel pressure of the pressure chamber 11 rises with the rising movement of the plunger 2 from this time. When the fuel pressure becomes the pressure of the fuel discharge port 12 or higher, high pressure discharge of the fuel remaining in the pressure chamber 11 is performed via a discharge valve unit 8, and the fuel is supplied to a common rail 23. This process is called a discharge process. Specifically, the compression process of the plunger 2 (the rising process from the bottom dead center to the top dead center) is configured by the spill process and the discharge process.

By controlling the timing of canceling energization to the electromagnetic coil 30*c* of the electromagnetic intake valve mechanism 30, the amount of the high pressure fuel to be discharged can be controlled.

If the timing of canceling energization to the electromagnetic coil 30*c* is made early, the ratio of the spill process is small and the ratio of the discharge process is large during the compression process.

More specifically, less fuel is spilled to the intake passage 10*c* (intake port 30*a*), and more fuel is discharged at a high pressure.

Meanwhile, if the timing of canceling the input voltage is made later, the ratio of the spill process is large and the ratio of the discharge process is small during the compression process. Specifically, more fuel is spilled to the intake passage 10*c*, and less fuel is discharged at a high pressure. The timing of canceling energization to the electromagnetic coil 30*c* is controlled by the command from the ECU.

By the configuration as above, the timing of canceling energization to the electromagnetic coil 30*c* is controlled, and thereby the amount of the fuel which is discharged at a high pressure can be controlled to the amount required by the internal combustion engine.

Thus, the fuel introduced into the fuel intake port 10*a* is introduced into the pressure chamber 11 of the pump housing 1, and the required amount is pressurized to a high pressure by reciprocating movement of the plunger 2, and is pressure-fed to the common rail 23 from the fuel discharge port 12.

An injector 24 and a pressure sensor 26 are provided to the common rail 23. The injectors 24 the number of which corresponds to the number of cylinders of the internal combustion engine are provided, and open and close in accordance with the control signal of the engine control unit (ECU) 27 to inject a fuel into the cylinders.

In the pump housing 1, a concave portion 1A as the pressure chamber 11 is formed in a center, and a hole 11A for fixing the discharge valve mechanism 8 is formed in an area from the inner peripheral wall of the pressure chamber 11 to the discharge port 12. Further, a hole 30A for mounting the electromagnetic intake valve mechanism 30 for supplying a fuel to the pressure chamber 11 is provided in an outer wall of the pump housing on the same axial line as the hole 11*a* for fixing the discharge valve mechanism 8.

The axial lines of the hole 11*a* for fixing the discharge valve mechanism 8 and the hole for mounting the electromagnetic intake valve mechanism 30 are formed in the direction orthogonal to the center axial line of the concave portion 1A as the pressure chamber 11, and the discharge valve mechanism 8 for discharging the fuel to the discharge passage from the pressure chamber 11 is provided.

Further, the cylinder 6 which guides the reciprocating movement of the plunger 2 is protrude to the pressure chamber.

In the first embodiment, the axial lines of the hole 11*a* for fitting the discharge valve mechanism 8 and the hole 30A for mounting the electromagnetic intake valve mechanism 30 are formed to be the same axial line, but according to this, assembly can be performed straight from the hole 30A for mounting the electromagnetic intake valve mechanism 30 to the hole 11*a* for fitting the discharge valve mechanism 8. Alternatively, the force at the time of press-fitting the discharge valve mechanism 8 can be applied from the hole 30A for mounting the electromagnetic intake valve mechanism 30. In this case, the diameter of the hole 30A in the minimum diameter portion needs to be configured to be larger than the maximum outside diameter of the discharge valve mechanism 8.

The discharge valve mechanism 8 is provided at an outlet of the pressure chamber 11. The discharge valve mechanism 8 is composed of a seat member (seat member) 8*a*, a discharge valve 8*b*, a discharge valve spring 8*c* and a holding member 8*d* as a discharge valve stopper.

In the state without a pressure difference in the fuel between the pressure chamber 11 and the discharge port 12, the discharge valve 8*b* is in pressure-contact with the seat member 8*a* by the biasing force by the discharge valve spring 8*c* and is in the valve closed state. It is not until the fuel pressure in the pressure chamber 11 becomes larger than the fuel pressure of the discharge port 12 by a specific value that the discharge valve 8*b* opens against the discharge valve spring 8*c*, and the fuel in the pressure chamber 11 is discharged to the common rail 23 through the discharge port 12.

When the discharge valve 8*b* opens, the discharge valve 8*b* contacts the holding member 8*d*, and its movement is restricted. Accordingly, the stroke of the discharge valve 8*b* is properly determined by the holding member 8*d*. If the stroke is too large, the fuel discharged to the fuel discharge port 12 flows back into the pressure chamber 11 again due to delay in closure of the discharge valve 8*b*, and therefore, the efficiency as the high pressure pump reduces. Further, the holding member 8*d* guides the discharge valve 8*b* so that the discharge valve 8*b* moves only in the stroke (axial) direction when the discharge valve 8*b* repeats opening and closing movement. By being configured as above, the discharge valve mechanism 8 functions as a check-valve which restricts the flowing direction of the fuel.

Further, the high pressure fuel supply pump is fixed to the engine by a flange holder 40, a flange 41 and a bush 43. The flange holder 40 is pressure-contacted and fixed to the engine by a set screw 42 via the flange 41. The bush 43 exists between the flange 41 and the engine. The flange holder 40 is fixed to the pump housing 1 by a screw threaded in an inner periphery, and therefore, the pump housing is fixed to the engine by this.

The bush 43 is fixed to the flange 41, whereby the flange 41 can be formed into a flat shape without a curved portion as shown in FIG. 2. Thereby, formation of the flange 41 is facilitated.

The pump housing 1 is further provided with a relief passage 311 which allows a downstream side of the discharge valve 8*b* and the intake passage 10*c* to communicate with.

The relief passage 311 is provided with a relief valve mechanism 200 which restricts the flow of the fuel to only one direction from the discharge passage to the intake passage 10*c*, and an inlet of the relief valve mechanism 200 communicates with the downstream side of the discharge valve 8*b* by a passage not illustrated.

Hereinafter, an operation of the relief valve mechanism 200 will be described. A relief valve 202 is pressed against a relief valve seat 201 by a relief spring 204 which generates a pressing force, and a set valve opening pressure is set so that when the pressure difference between the inside of the intake chamber and the inside of the relief passage becomes a specified pressure or more, the relief valve 202 separates from the relief valve seat 201 to open. Here, the pressure when the relief valve 202 starts to open is defined as the set valve opening pressure.

The relief valve mechanism 200 is composed of a relief valve housing 206 integrated with the relief valve seat 201, the relief valve 202, a relief presser 203, the relief spring 204 and a relief spring adjuster 205. The relief valve mechanism 200 is assembled outside the pump housing 1 as a subassembly, and thereafter, is fixed to the pump housing 1 by press-fitting.

First, the relief valve 202, the relief presser 203 and the relief spring 204 are sequentially inserted into the relief valve housing 206, and the relief spring adjuster 205 is fixed to the relief valve housing 206 by press-fitting. The set load of the relief spring 204 is determined by the fixing position of the relief spring adjuster 205. The valve opening pressure of the relief valve 202 is determined by the set load of the relief spring 204. The relief subassembly 200 thus constructed is fixed to the pump housing 1 by press-fitting.

In this case, the valve opening pressure of the relief valve 200 is set to a pressure higher than the maximum pressure in the normal operation range of the high pressure fuel supply pump.

The abnormal high pressure in the common rail 23 which occurs due to a failure of a fuel injection valve which supplies a fuel to the engine, and a failure of the ECU 27 or the like which controls the fuel injection valve, the high pressure fuel supply pump and the like becomes the predetermined valve opening pressure of the relief valve or higher, the fuel passes through the relief passage 211 from the downstream side of the discharge valve 8*b* and reaches the relief valve 202. The fuel which passes through the relief valve 202 is released to the intake passage 10*c* which is the low pressure portion of a relief passage 208 which is provided in the relief spring adjuster 205. Thereby, the high pressure portion such as the common rail 23 is protected.

The outer periphery of a cylinder 6 is held by a cylinder holder 7, and the cylinder holder 7 is held inside a flange holder 40. A screw 410 threaded on the inner periphery of the flange holder 40 is screwed into a screw 411 which is threaded in the pump housing 1, and thereby, the cylinder 6 is fixed to the pump housing 1 via the cylinder holder 7. The cylinder 6 holds the plunger 2, which advances and retreats in the pressure chamber 11, slideably along the advancing and retreating direction.

A tappet 3 which converts the rotating movement of a cam 5 attached to a camshaft of the engine into vertical movement and transmits the vertical movement to the plunger 2 is provided at a lower end of the plunger 2. The plunger 2 is in pressure-contact with the tappet 3 by a spring 4 via a retainer 15. The retainer 15 is fixed to the plunger 2 by press-fitting. Thereby, with rotating movement of the cam 5, the plunger 2 can be vertically advanced and retreated (reciprocated).

Further, a plunger seal 13 held at the lower end portion of the inner periphery of the cylinder holder 7 is installed in the state in which it is slideably in contact with the outer periphery of the plunger 2 at the lower end portion in the drawing of the cylinder 6, whereby the fuel in the seal chamber 10*f* is prevented from flowing to the tappet 3 side, that is, to the inside of the engine. At the same time, lubricant oil (also including engine oil) which lubricates the sliding portion in the engine room is prevented from flowing inside the pump housing 1.

Here, the intake passage 10*c* is connected to the seal chamber 10*f* via the intake passage 10*d*, and the intake passage 10*e* provided in the cylinder 6, and the seal chamber 10*f* is always connected to the pressure of the sucked fuel. When the fuel in the pressure chamber 11 is pressed to a high pressure, a very small amount of high pressure fuel flows into the seal chamber 10*f* through a slide clearance of the cylinder 6 and the plunger 2, but the high pressure fuel which flows in is released to intake pressure, and therefore, the plunger seal 13 is not broken due to a high pressure.

Further, the plunger 2 is composed of a large diameter portion 2*a* which slides with the cylinder 6, and a small diameter portion 2*b* which slides with the plunger seal 13. The diameter of the large diameter portion 2*a* is set to be larger than the diameter of the small diameter portion 2*b*, and the large diameter portion 2*a* and the small diameter portion 2*b* are set to be coaxial with each other. In the case of the present embodiment, the diameter of the large diameter portion 2*a* is set at 10 mm, and the diameter of the small diameter portion 2*b* is set at 6 mm. By setting like this, the pressure pulsation at the low pressure side, which occurs at the low pressure side upstream from the electromagnetic intake valve mechanism 30 with vertical movement of the plunger, can be reduced.

Hereinafter, a mechanism which reduces the pressure pulsation at the low pressure side by configuring the plunger 2 by the large diameter portion 2*a* and the small diameter portion 2*b* will be described by using FIGS. 4, 5 and 6.

Figure 4:
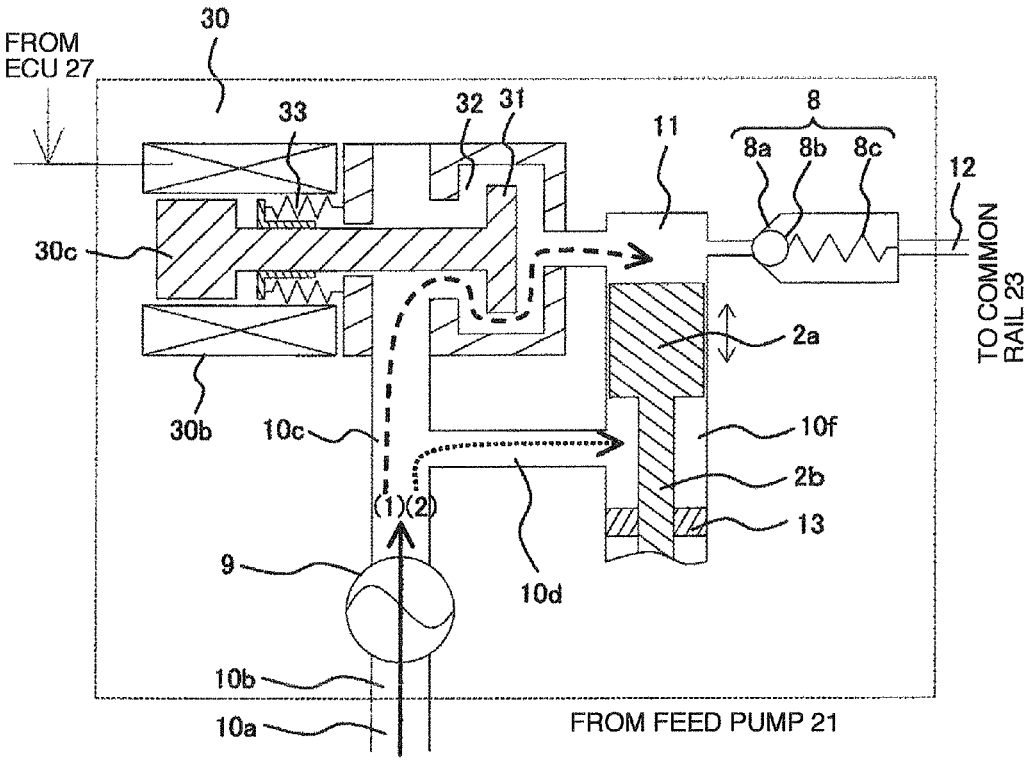
FIG. 4 is one example of a fuel supply system using the high pressure fuel supply pump according to the first embodiment in which the present invention is carried out, and especially shows a flow of a fuel in the high pressure fuel supply pump in detail.

FIG. 4 is a system diagram of the high pressure fuel supply pump in the present embodiment.

Figure 5:
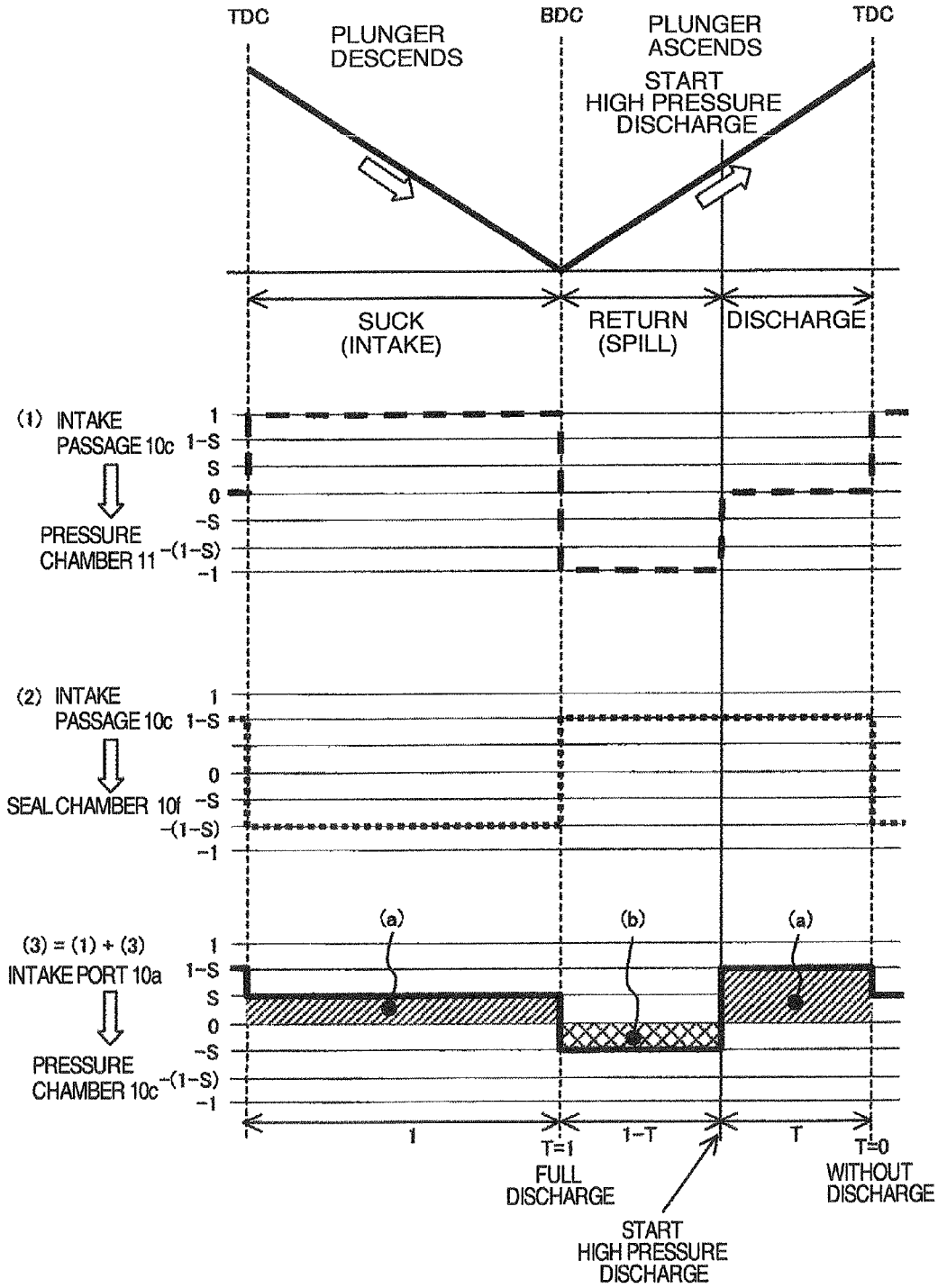
FIG. 5 is a diagram showing a generation mechanism of intake pressure pulsation which generates by the high pressure fuel supply pump according to the first embodiment in which the present invention is carried out.

FIG. 5 shows the relationship of the movement of the plunger 2 and the movement of the fuel inside the high-pressure fuel supply pump.

Figure 6:
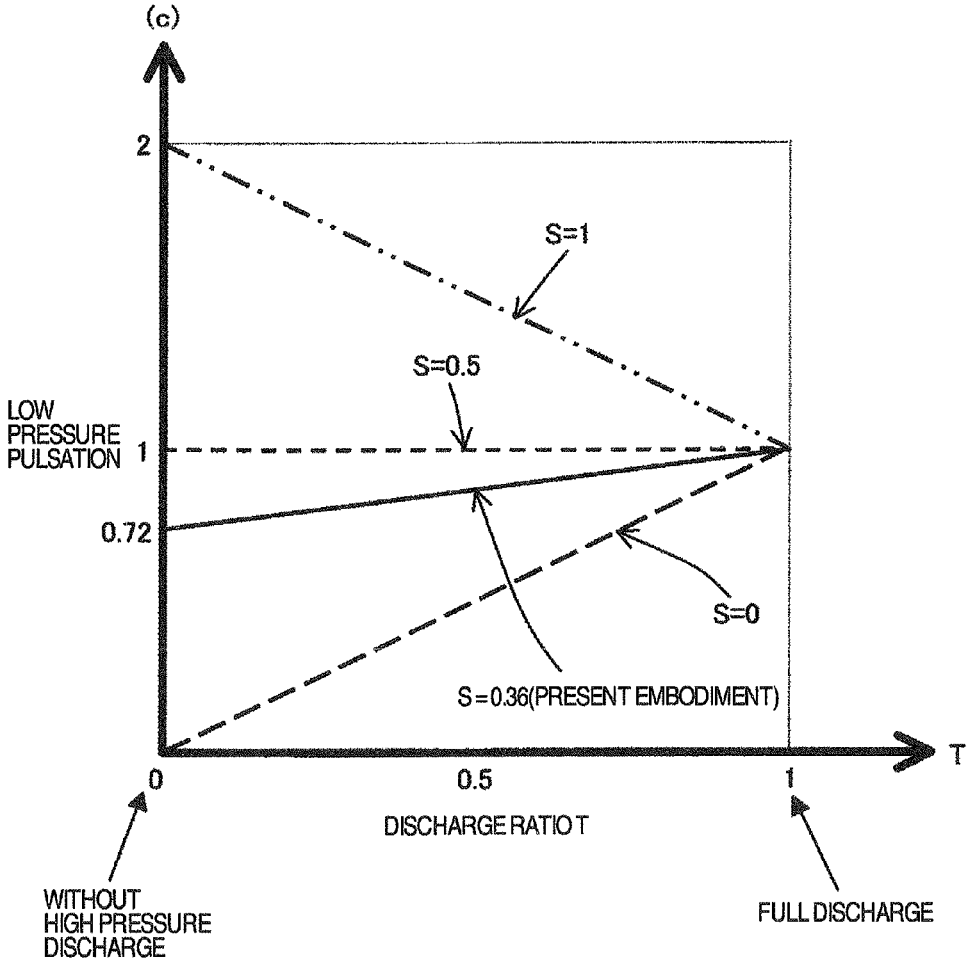
FIG. 6 is a diagram showing the relationship of the intake pressure pulsation which generates by the high pressure fuel supply pump by the first embodiment in which the present invention is carried out and an area of a small diameter portion 2*a* of a plunger 2.

FIG. 6 shows the relationship of an area ratio of the large diameter portion 2*a* and the small diameter portion 2*b* of the plunger 2, and the pressure pulsation which occurs in the low pressure pipe 28.

FIG. 4 shows a flow of the fuel inside the high pressure fuel supply pump in the present embodiment. The fuel which flows inside the high pressure fuel supply pump from the intake port 10*a* passes through the metal damper 9 (3), part of it flows into the pressure chamber 11 through the intake valve member 31 from the intake passage 10*c* (1), and the remaining part flows into the seal chamber 10*f* via the intake passage 10*d* from the intake passage 10*c* (2). Specifically, the relationship of the fuel which flows inside the high pressure fuel supply pump is as described below.

$$(3)=(1)+(2)$$

Figure 7:
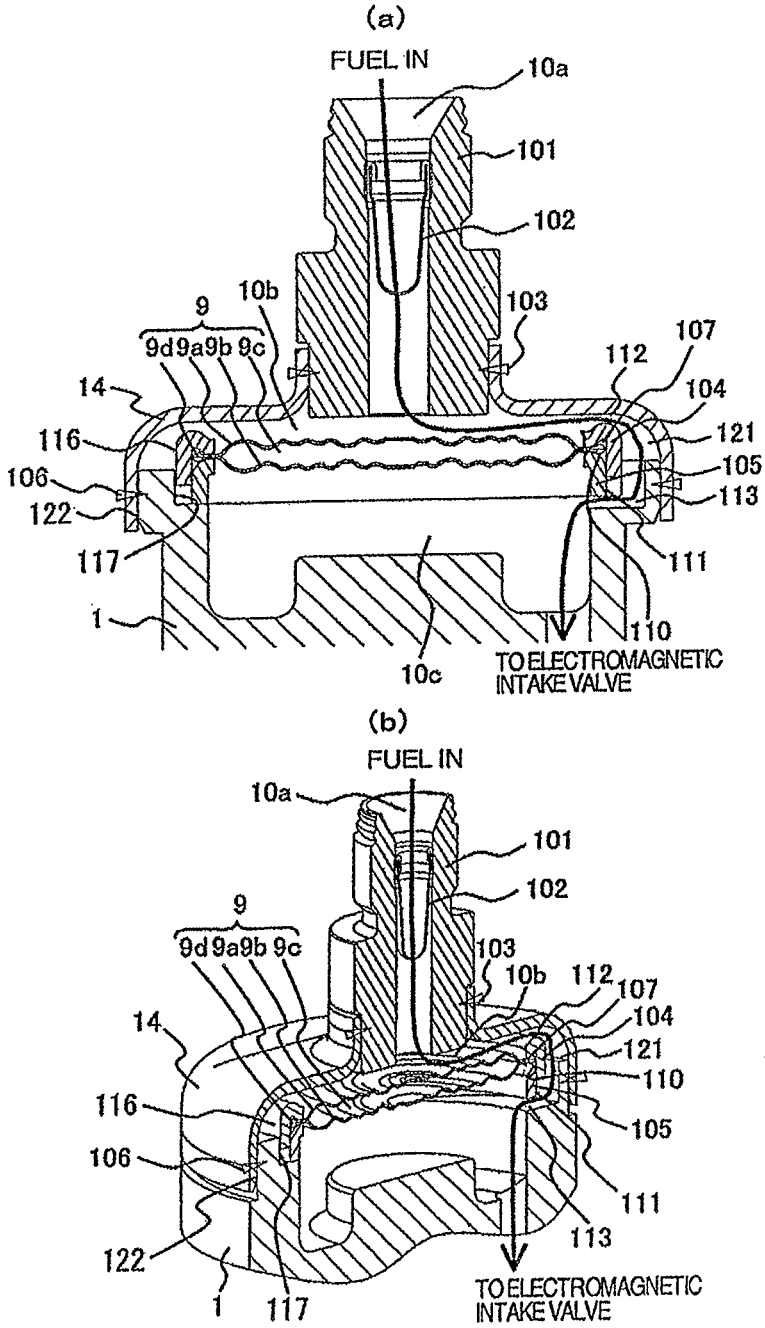
FIGS. 7(*a*) and (*b*) are vertical sectional views of the high pressure fuel supply pump according to the first embodiment in which the present invention is carried out, and are an enlarged view (a) and a perspective view (b) especially of a portion relating to the metal diaphragm damper 9.

Here, the flow of the fuel in the direction of the arrow in FIG. 7 is defined as positive value. A negative value means the flow of the fuel in the direction opposite to the arrow.

FIG. 5 shows the relationship of the movement of the plunger 2, and the fuel flows (1), (2) and (3).

The table on the uppermost stage expresses the movement of the plunger, TDC (abbreviation of TOP DEAD CENTER) represents the time when the plunger 2 is at the uppermost position in FIG. 2, and BDC (abbreviation of BOTTOM DEAD CENTER) represents the time when the plunger 2 is at the lowermost position. The descending movement process of the plunger 2 is composed of the intake process, and the ascending movement process is composed of the spill process and the discharge process, which is as described above.

Further, the diagram below the table shows the fuel flows (1), (2) and (3).

"S" in the drawing represents the ratio of "sectional area of the small diameter portion 2*b*" to "sectional area of the large diameter portion 2*a*" in the plunger 2. In the case of the present embodiment, the diameter of the large diameter portion 2*a* is 10 mm, whereas the diameter of the small diameter portion 2*b* is 6 mm, and therefore, $$S = 6^2 / 10^2$$

$$= 0.36$$

Next, the state of each of the process of the fuel flows (1), (2) and (3) will be described.

Intake Process (1) The volume of the pressure chamber 11 increases by the descending movement of the plunger 2, and the fuel corresponding to the increase in volume flows therein from the intake passage 10*c*. The increase amount in volume in this case occurs by the large diameter portion 2*a*, and the increase amount at this time is set as 1. Accordingly, the flow rate of the fuel in the table is 1.

(2) The volume of the seal chamber 10*f* decreases since the lower end of the large diameter portion 2*a* descends into the seal chamber 10*f* by the descending movement of the plunger 2, and the fuel corresponding to the decrease in the volume flows back from the seal chamber 10*f* to flow out to the intake passage 10*c*. The decrease amount of the volume in this case becomes $$1-S,$$

and the flow of the fuel with the direction taken into consideration is $$-(1-S).$$

(3) The sum of the above described (1) and (2) becomes the fuel (3) which flows into the intake passage 10*c* inside the high pressure fuel supply pump from the intake port 10*a*, and therefore, the fuel of $$1+[-(1-S)]=S$$

flows into the high pressure fuel supply pump.

Spill Process (1) The volume of the pressure chamber 11 decreases by the ascending movement of the plunger 2, and the fuel corresponding to the decrease in the volume flows out to the intake passage 10*c*. As in the intake process, the decrease amount of the volume in this case occurs by the large diameter portion 2*a*, and the decrease amount at this time is set as 1. Accordingly, the flow rate of the fuel is −1 in the table.

(2) The volume of the seal chamber 10*f* increases since the lower end of the large diameter portion 2*a* ascends inside the seal chamber 10*f* by the ascending movement of the plunger 2, and the fuel corresponding to the increase in the volume flows into the intake passage 10*c* from the seal chamber 10*f*. The increase amount of the volume in this case is $$1-S,$$

and the flow of the fuel is $$1-S.$$

(3) The fuel (3) which flows into the intake passage 10*c* from the intake port 10*a* is $$[-1]+[(1-S)]=-S.$$

Discharge Process (1) The volume of the pressure chamber 11 decreases by the ascending movement of the plunger 2, and the fuel in the pressure chamber 11 is pressurized to a high pressure. The fuel is supplied to the common rail 23 through the discharge mechanism 8 and the fuel discharge port 12. In this case, the volume in the pressure chamber 11 decreases, but the fuel does not flow between the intake passage 10*c* and the pressure chamber 11. Accordingly, the flow rate of the fuel becomes zero.

(2) The same operation as in the above described spill process is performed, and therefore, the fuel flow is $$1-S.$$

(3) The fuel (3) which flows into the intake passage 10*c* from the intake port 10*a* is $$0+[(1-S)]=1-S.$$

The pressure pulsation which occurs to the intake passage 28 between the feed pump 21 and the intake port 10*a* relates to the "fuel (3) which flows into the intake passage 10*c* from the intake port 10*a*". In the table at the lowermost stage of FIG. 8, T represents the ratio of the suction process in the ascending process of the plunger 2. The ratio of the intake process in the rising process of the plunger 2 is $$1-T.$$

The discharge process does not exist, and the fuel is not discharged at a high pressure, when $$T=0.$$

The spill process does not exist, and all the fuel which flows into the pressure chamber 11 is pressurized to a high pressure and supplied to the common rail 23 when $$T=1.$$

This mode will be called full discharge.

The magnitude of the intake pressure pulsation which occurs to the intake pipe 28 is determined by the sum of the following two amounts.

(a) The total amount of the fuel which flows into the intake passage 10*c* from the intake port 10*a*

(b) The total amount of the fuel which flows out to the intake passage 10*a* from the intake port 10*c*

Here, (a) corresponds to the area of the slashed portion in the table at the lowermost stage of FIG. 5, $$(a)=[S*1]+(1-S)T.$$

Meanwhile, (b) corresponds to the area of the cross-hatched portion, and therefore, $$(b)=S(1-T).$$

Therefore, (c)=(a)+(b) is calculated, and $$(c)=(a)+(b)=(1-2S)T+2S$$

is obtained.

FIG. 6 shows the relationship of T and the above described (c).

In the state of S=1, the diameters and the sectional areas of the small diameter portion 2*a* and the large diameter portion 2*b* of the plunger 2 are equal, and no stage is present in the plunger 2.

At this time, the pressure pulsation which occurs in the intake pipe 28 is the largest when T=0, that is, when the high pressure discharge is zero. This means that all the fuel sucked in the pressure chamber 11 is temporarily spilled to the intake port 10*a*.

Meanwhile, as T becomes larger, the intake pressure pulsation becomes smaller. This shows that the fuel in the pressure chamber 11 is discharged at a high pressure into the common rail 23 in the discharge process, and therefore, the fuel which spills to the intake port 10*a* becomes less correspondingly.

In the state of S=0, the sectional area of the small diameter portion 2*a* of the plunger 2 is 0, and this is the state which cannot actually happen.

When T=0, intake pressure pulsation does not occur. This shows that the fuel only comes and goes from and to the pressure chamber 11 and the seal chamber 10*f*, and therefore, the fuel does not come and go from and to the intake port 10*a* and the intake passage 10*c*.

As T becomes larger, the pressure pulsation becomes larger. This is because the fuel is also sucked into the seal chamber 10*f* at the same time when the fuel is discharged at a high pressure to the common rail 23 from the pressure chamber 11 in the discharge process, and therefore, the fuel flows into the intake passage 10*c* from the intake port 10*a*.

When S=0.5, the low pressure pulsation is constant irrespective of the value of T.

From the above, S is desired to be as small as possible.

However, setting S to be small means setting the small diameter portion 2*b* of the plunger 2 to be small, and if the small diameter portion 2*b* is made too small, the strength of the small diameter portion 2*a* becomes insufficient to break the plunger 2.

In the present invention, the diameter of the large diameter portion 2*a* is set at 10 mm, the diameter of the small diameter portion 2*b* is set at 6 mm, and S is set so that S=0.36 as described above. The characteristics with S=0.36 are shown in FIG. 6.

Thereby, with the strength of the small diameter portion 2*b* being ensured, the low pressure pulsation can be reduced as compared with the time when S=1.

Next, the metal diaphragm damper 9 for absorbing pressure pulsation which occurs due to the above described mechanism, and a method for fixing it will be described.

FIG. 7 is an enlarged view and a perspective view of the metal diaphragm damper 9 portion for absorbing pressure pulsation in FIG. 2.

Figure 8:
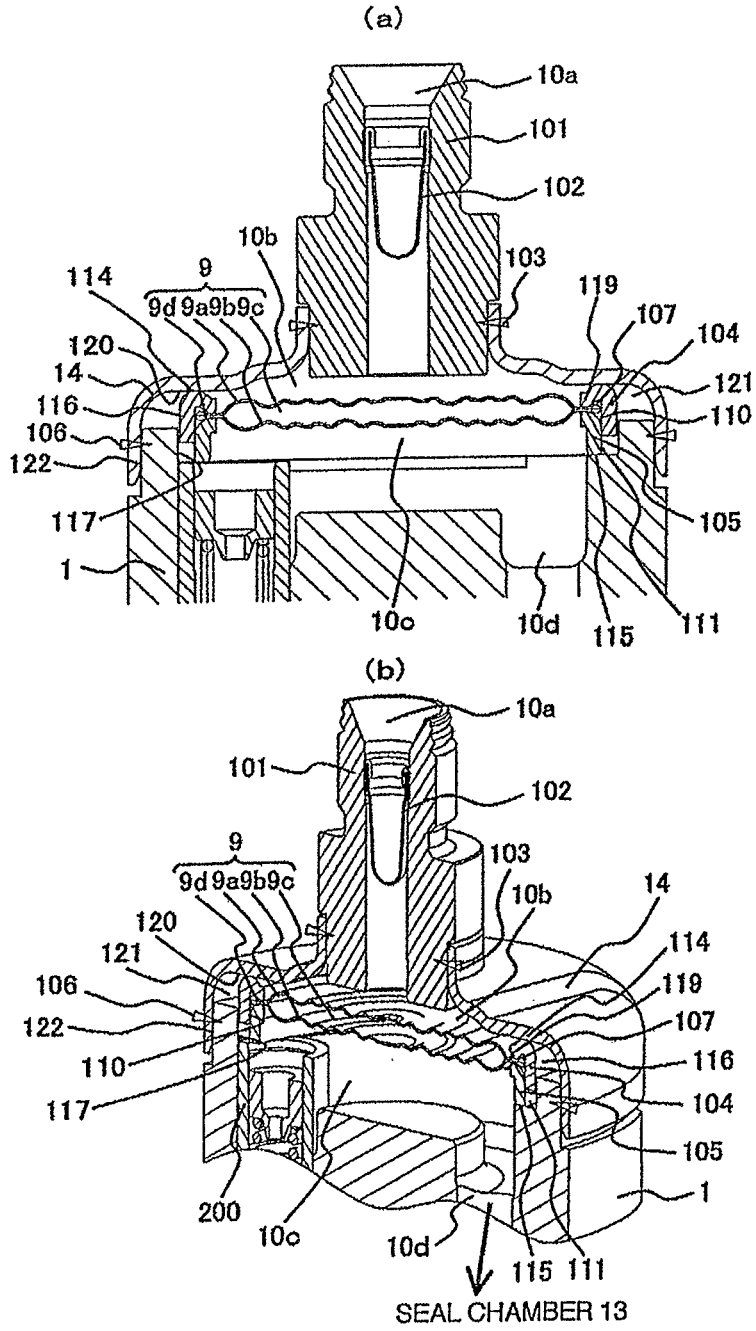
FIGS. 8(*a*) and (*b*) are vertical sectional views of the high pressure fuel supply pump according to the first embodiment in which the present invention is carried out, express a section perpendicular to FIG. 7, and are an enlarged view (a) and a perspective view (b) especially of the portion relating to the metal diaphragm damper 9.

FIG. 8 is an enlarged view and a perspective view of the metal diaphragm damper 9 portion for absorbing pressure pulsation in FIG. 3.

Figure 9:
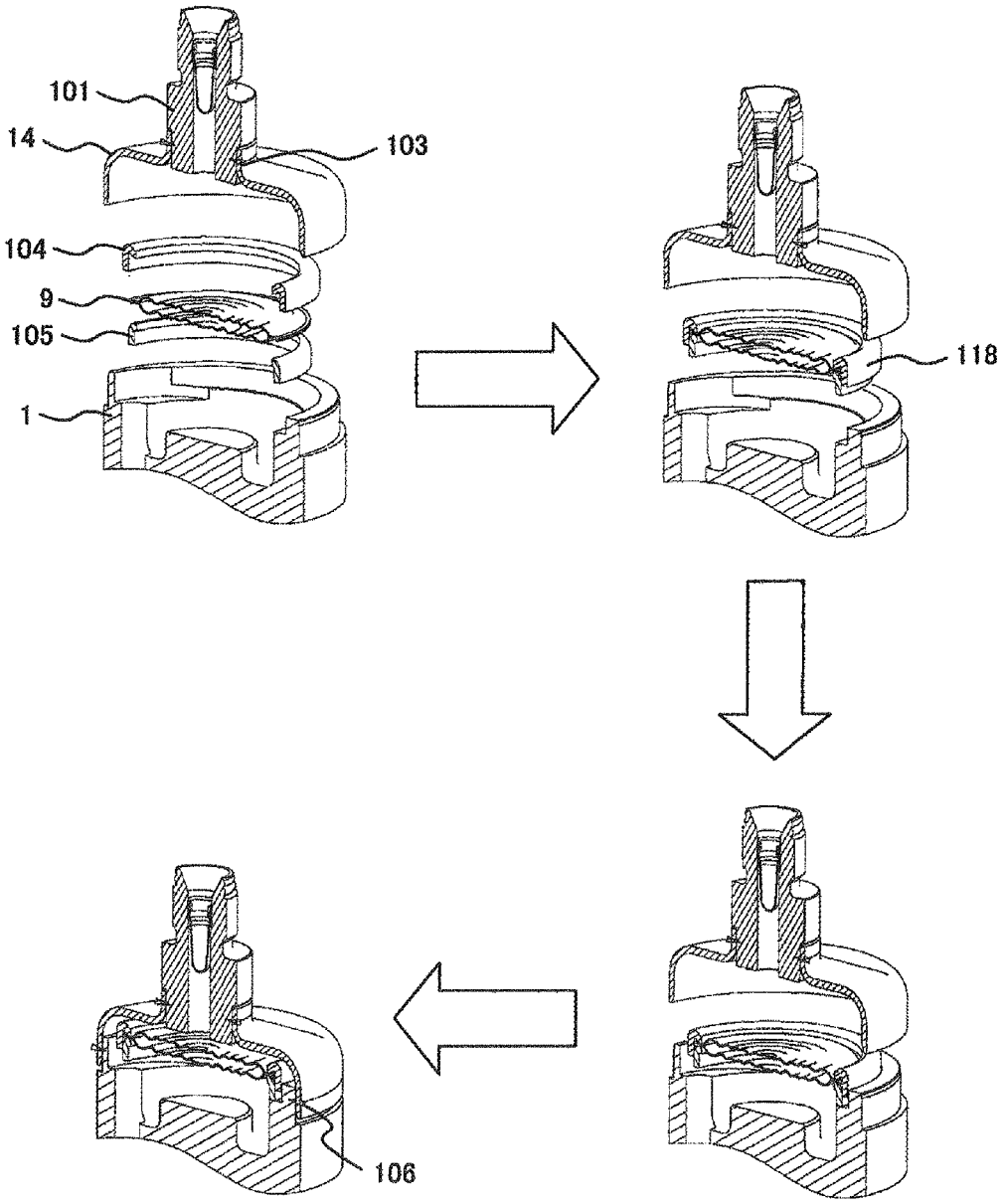
FIG. 9 is a view showing a damper unit 118 at a time of assembling the high pressure fuel supply pump according to the first embodiment in which the present invention is carried out, and a method for assembling the damper unit 118 to the pump housing 1 and the damper cover 14.

FIG. 9 shows an assembly procedure when fixing the damper unit 118 to the pump housing 1.

The damper unit 118 is configured by two metal diaphragms 9*a* and 9*b*, and entire outer peripheries of them are fixed to each other by welding at a weld portion 9*d* with gas 9*c* being sealed in the space between both the diaphragms. A plane portion is provided inside the weld portion 9*d*, and by sandwiching this portion, the damper unit is installed in the low pressure passage of the high pressure fuel supply pump. As a result, the intake passages 10*b* and 10*c* are formed the pass throughout-surrounding of the damper unit.

When low pressure pulsation is loaded on both surfaces of the metal diaphragm damper 9, the metal diaphragm damper 9 changes its volume, and thereby, reduces the low pressure pulsation.

The metal diaphragm damper 9 is vertically held by an upper holding member 104 and a lower holding member 105, and at the time of assembly, the metal diaphragm damper 9 is unitized in this state first to form the damper unit 118, as in FIG. 9.

The upper holding member 104 has a curl portion 119, and an upper end of the lower holding member 105 faces the curl portion 119 to hold the flat plate portion of the metal diaphragm damper 9. The diameters of the contact portion of the upper holding member 104 and the metal diaphragm damper 9 and the contact portion of the lower holding member 105 and the metal diaphragm damper 9 are equal, and they are in contact over the entire circumference.

An inner peripheral portion 110 of the upper holding member 104 and an outer peripheral portion 111 of the lower holding member 105 are fixed by press fit, and are fixed to each other at the peripheral edge portion at the outer side from the metal diaphragm damper 9, and further, the weld portion 9*d* of the metal diaphragm damper 9 is disposed in a space 107 formed between the upper holding member 104 and the lower holding member 105.

By such a configuration, the metal diaphragm damper 9 can be fixed without generating stress in the weld portion 9*d* of the metal diaphragm damper 9.

Further, the metal diaphragm damper 9 is held and fixed over the entire circumference to be vertically symmetrical, and therefore, stress does not occur by fixing except for the fixing portion.

Further, three members that are the upper and lower holding members 104 and 105 and the metal diaphragm damper 9 are easily positioned in the diameter direction by the inner peripheral portion 110 of the upper holding member 104.

The damper unit 118 which is configured as described above is housed in a concave portion formed in the pump housing 1. At this time, an outer peripheral portion 116 of the upper holding member 104 and an inner peripheral portion 117 of the pump housing 1 are positioned in the diameter direction by loose fitting instead of press-fitting.

In this state, a damper cover 14 is further assembled from above.

The damper cover 14 is formed into a cup shape, and a cylindrical outer surface at its open side is fixed to the pump housing 1 by welding 106.

The damper cover 14 has a projected portion 120 which is projected to an inner side, and the upper holding member 104 is in contact with the damper cover 14 at a contact portion 114. The projected portion 120 is in a annular protruded shape having a damper cover omitted portion 112 with a part of it being omitted, and at the damper cover omitted portion 112, the damper cover 14 and the damper unit 118 are not in contact with each other.

A recess end surface 115 of the pump housing 1 is in contact with the lower holding member 105, and has a annular structure with a part of it being omitted by a body omitted portion 113, and at the body omitted portion 113, the pump housing 1 and the damper unit 118 are not in contact with each other. In the body omitted portion 113, the inner peripheral portion 117 is also omitted, and the body omitted portion 113 does not contribute to positioning of the upper holding member 104 and the outer peripheral portion 116.

Further, the damper unit 118 is fixed in such a way as to hold the upper holding member 104 by the damper cover 14 from the upper side and hold the lower holding member 105 from the lower side. This is fixed in the direction to promote press-fitting of the upper holding member 104 and the lower holding member 105.

This prevents press-fitting of the upper holding member 104 and the lower holding member 105 from becoming loose due to pressure pulsation of the fuel, vibration of the engine and the like, and prevents fixing of the metal diaphragm damper 9 from becoming loose.

The intake passage 10*b* between the damper cover 14 and the metal diaphragm damper 9 communicates with the annular space 121 between the damper cover 14 and the upper holding member 104 by the damper cover omitted portion 112. The intake passage 10*c* between the pump housing 1 and the metal diaphragm damper 9 also communicates with the annular space 121 between the damper cover 14 and the upper holding member 104 by the body omitted portion 113.

Thereby, the damper unit 118 is held in the state sandwiched by the damper cover 14 and the pump housing 1, and at the same time, the intake passage 10*b* and the intake passage 10*c* communicate with each other. The fuel which flows into the high pressure fuel supply pump from the intake port 10*a* flows into the intake passage 10*b*, and subsequently into the intake passage 10*c*, and therefore, the fuel flow (3) in FIG. 4 all passes through the metal diaphragm damper 9. Thereby, the fuel spreads over both surfaces of the metal diaphragm damper 9, and the fuel pressure pulsation can be efficiently reduced by the metal diaphragm damper 9.

The damper cover 14 is made by working a rolled steel seat by pressing, and therefore, the seat thickness of the cover is uniform anywhere. When the damper cover 14 is fixed to the pump housing 1, the damper cover 14 is temporarily press-fitted to the pump housing 1 by the press-fitting portion 122 first. At this timing, the projected portion 120 of the damper cover 14 and the upper holding member 104 are already in contact with each other at the contact portion 114, and the recess end surface 115 of the pump housing 1 and the lower holding member 105 are in contact with each other. Therefore, the damper unit 118 is rigidly fixed in such a manner as to be sandwiched by the pump housing 1 and the damper cover 14.

In this state, the press-fitting portion 122 is liquid-tightly fixed by applying welding to the entire circumference in such a way as to penetrate through the damper cover 14 at the weld portion 106. Thereby, the inside and the outside of the high pressure fuel supply pump are completely shut off to be liquid-tight at the weld portion 106, so that the fuel is sealed against the outside.

By thermal distortion which occurs after welding, the damper cover 14 displaces in the direction to press the damper unit 118 with the pump housing 1 and the damper cover 14, and therefore, the holding force of the damper unit 118 does not attenuate even after welding.

Further, as shown in FIG. 3, the outside diameter of the relief valve housing 206 is fixed to the pump housing 1 by press-fitting. The press-fitting load is set at such interference as to prevent the relief valve housing 206 from slipping upward in the drawing by the high-pressure fuel in the relief passage 211.

However, the mechanism is such that even if the relief valve housing 206 slips upward in the drawing by the high-pressure fuel due to some errors, the relief valve housing 206 contacts the lower holding member 105 first, where the relief valve housing 206 is prevented from slipping off.

More specifically, the relief passage 211 which is the hole in which the relief valve housing 206 is press-fitted is in the positional relationship to be superimposed on the recess end surface 115 of the pump housing 1, and before the damper unit 118 is inserted into the pump housing 1, the relief valve mechanism 200 is fixed to the relief passage 211 by press-fitting. At this time, the relief valve mechanism 200 is fixed by press-fitting so that the upper end surface of the relief valve housing 206 is on the lower side from the recess end surface 115 of the pump housing 1.

By adopting such a configuration, even if the relief valve housing 206 slips off by the high-pressure fuel, the relief valve housing 206 contacts the lower holding member 105 first.

Further, in the present embodiment, the intake joint 101 is fixed to the damper cover omitted portion 112 of the damper cover 14 by the weld portion 103. The filter 102 is fixed to the intake joint 10*a*. The intake port 10*a* is formed in the intake joint 101. The fuel which flows into the high-pressure fuel supply pump all passes through the filter.

Embodiment 2

Next, a second embodiment of the present invention will be described.

The difference between the second embodiment and the first embodiment is only the position of the intake joint 101. The parts except for this are the same as those in the first embodiment, and the described codes and numerals are all common to those of the first embodiment.

Figure 10:
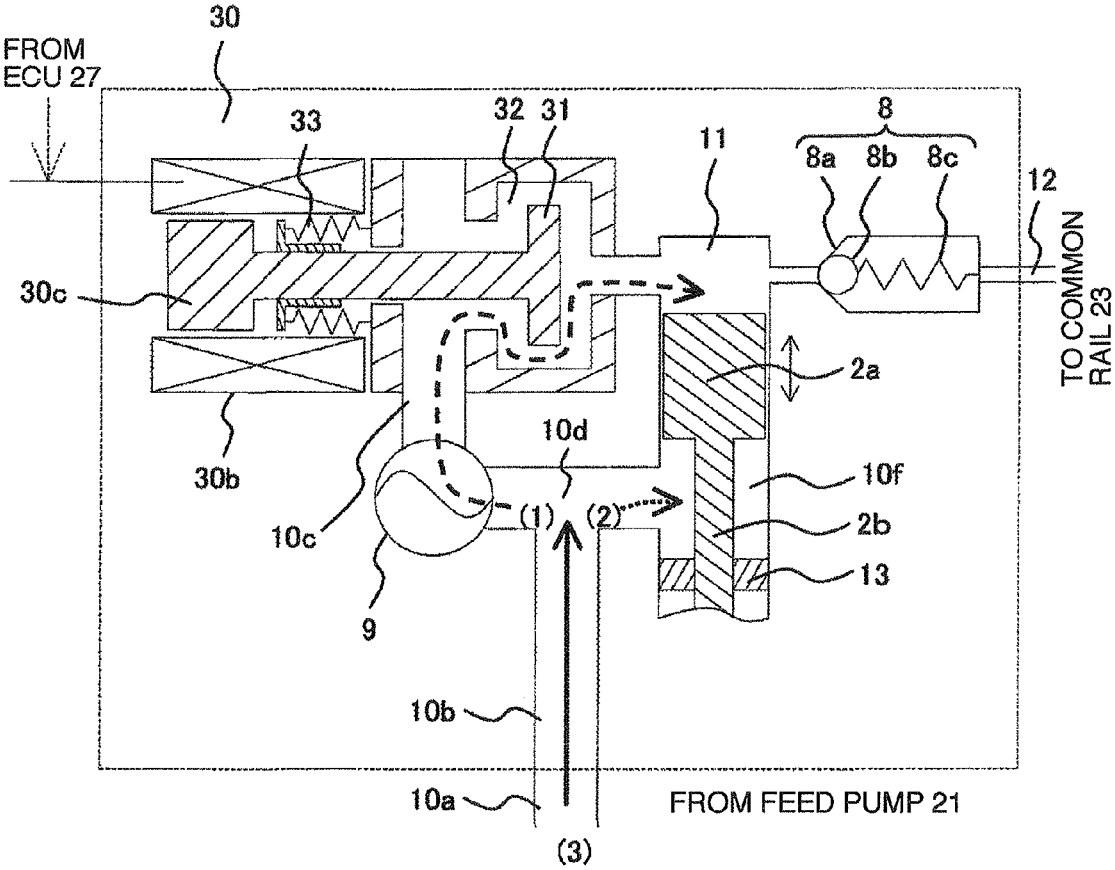
FIG. 10 shows one example of a system diagram of a high pressure fuel supply pump according to a second embodiment in which the present invention is carried out, and especially shows a flow of a fuel in the high pressure fuel supply pump in detail.

FIG. 10 shows a system diagram of the high-pressure fuel supply pump in the present embodiment.

Figure 11:
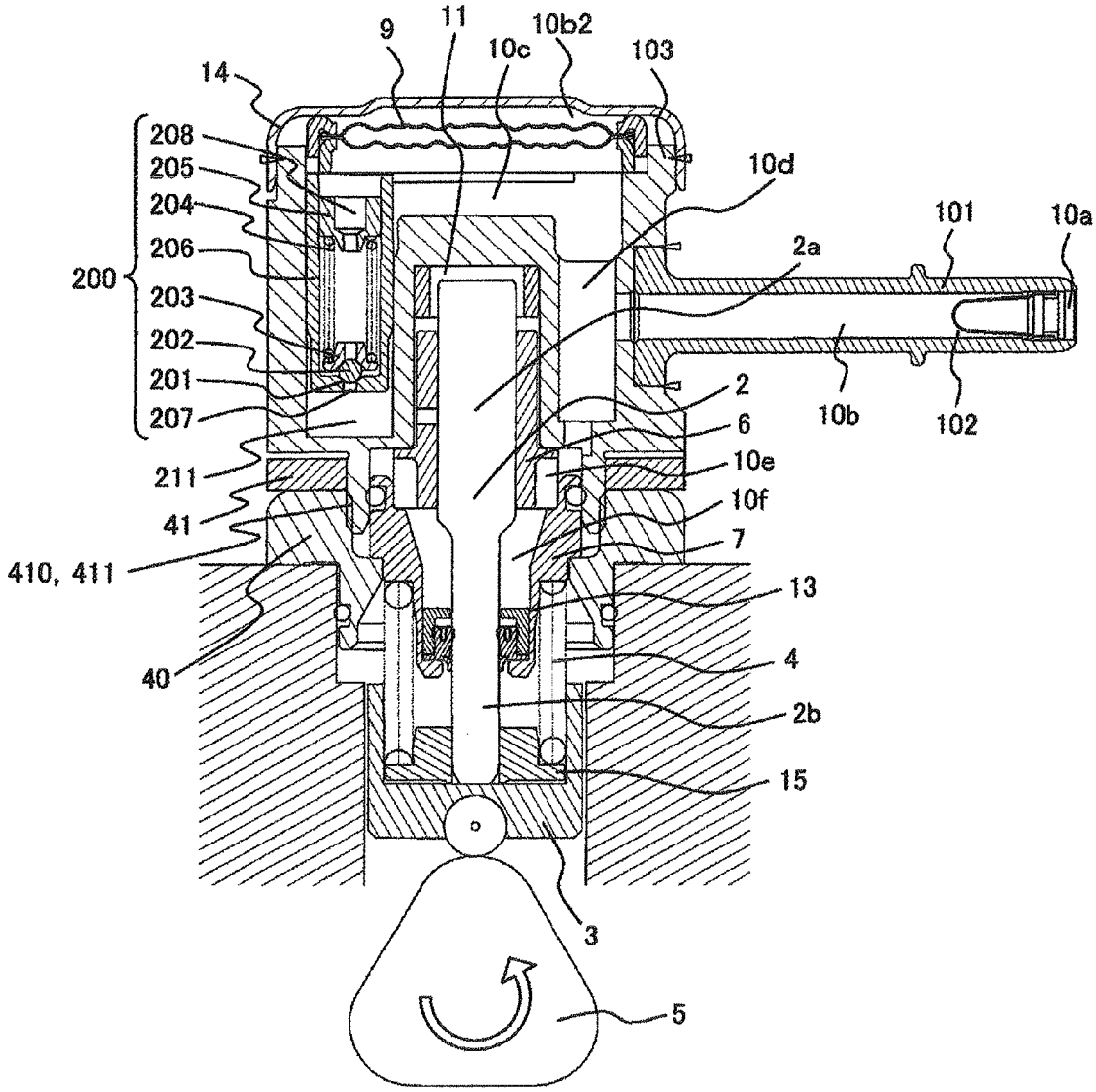
FIG. 11 is a vertical sectional view of the high pressure fuel supply pump according to the second embodiment in which the present invention is carried out.

FIG. 11 is a vertical sectional view of the high-pressure fuel supply pump in the present embodiment.

The intake joint 101 is mounted to the pump housing 1, and is fixed by the weld portion 103.

The intake port 10*a* is formed in the intake joint 101, and the filter 102 is fixed into the intake joint 101. The fuel which flows into the high-pressure fuel supply pump all passes through the filter 102.

The intake port 10*a* is connected to the intake passage 10*d*, a low-pressure fuel which enters the inside of the high-pressure fuel supply pump from the intake port 10*a* passes through the filter 102, and is guided to the intake passage 10*d* first (3). From the intake passage 10*d*, the fuel is divided into a fuel (1) which passes through intake passages 10*b*2 and 10*c* and goes to the pressure chamber 11, and a fuel (2) which goes to the seal chamber 10*f*. Accordingly, the following relationship is also established in this case.

$$(3)=(1)+(2)$$

In the present embodiment, the metal diaphragm damper 9 exists between the pressure chamber 11 and the intake passage 10*d*. In this case, the metal diaphragm damper 9 mainly absorbs and restrains the pressure pulsation which generates in the fuel (1) which goes to the pressure chamber 11 from the intake passage 10*d*.

The intake passage 10*b*2 and the intake passage 10*c* communicate with each other through the annular space 121 as in embodiment 1. Thereby, the fuel sufficiently spreads over both surfaces of the metal diaphragm damper 9, and therefore, the pressure pulsation can be sufficiently restrained.

By the aforementioned embodiment 1 and the present embodiment 2, the position of the intake joint can be properly selected in accordance with the layout of each engine. In this case, the high-pressure fuel supply pump can be kept compact and light without increasing the size and weight of the high-pressure fuel supply pump.

Embodiment 3

Next, a third embodiment of the present invention will be described.

The difference between the third embodiment and the first embodiment is only a projection length 123 of the lower holding member 105 from the upper holding member 104. The parts except for this are the same as those in the first embodiment, and the described codes and numerals are all common to the first embodiment.

Figure 12:
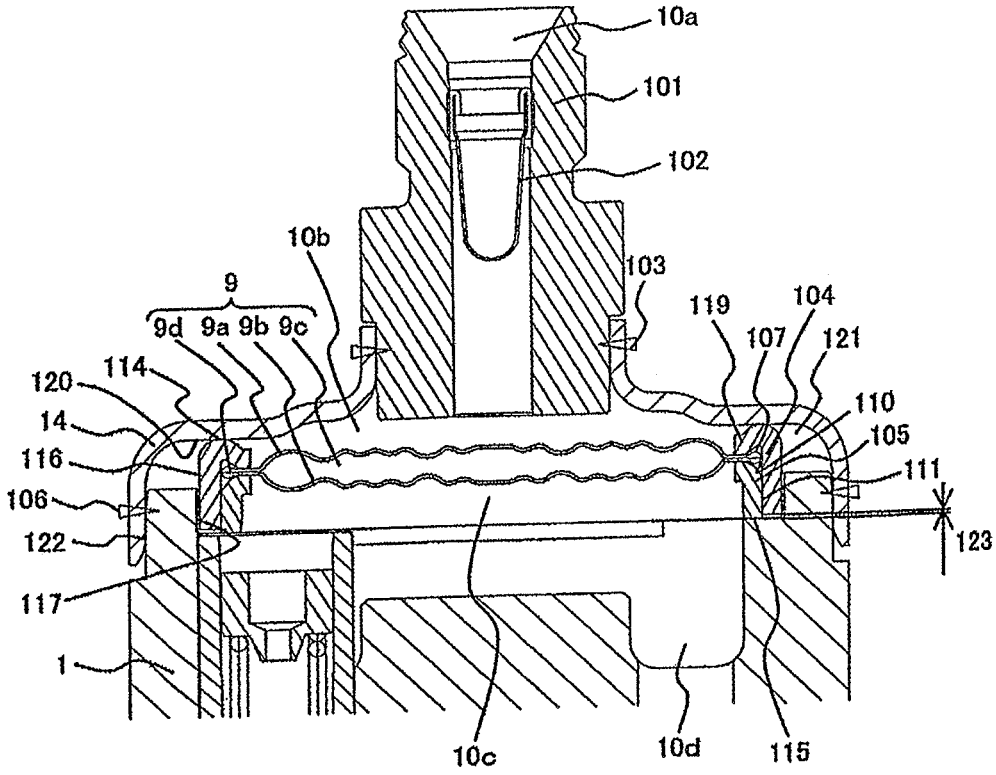
FIG. 12 is a vertical sectional view of a high pressure fuel supply pump according to a third embodiment in which the present invention is carried out, and is an enlarged view of a periphery of a metal diaphragm damper 9 portion.

FIG. 12 is a vertical sectional view of a high-pressure fuel supply pump in the present embodiment, and is an enlarged view of the metal diaphragm damper 9 portion for absorbing pressure pulsation.

In the present embodiment, the lower holding member 105 projects to the lower side in the drawing from the upper holding member 104 as in the first embodiment. The projection amount is set as 123.

The upper holding member 104 contacts the damper cover 14, whereas the lower holding member 105 contacts the pump housing 1, which is the same as in the first embodiment.

In the present embodiment, the projection amount 123 is set to be as small as 0.5 mm or less.

By setting like this, the press-fitting portion of the upper holding member 104 and the lower holding member 105 can be set to be sufficiently long, and therefore, even if a variation (individual difference) occurs to the fixing force when the damper unit 118 is fixed to between the damper cover 14 and the pump housing 1, the variation can be absorbed, and a variation of the force with which the upper holding member 104 and the lower holding member 105 pinch the metal diaphragm damper 9 can be made small.

By thermal distortion which occurs after the damper cover 14 is welded to the pump housing 1, the damper cover 14 displaces in the direction to press the damper unit 118 by the pump housing 1 and the damper cover 14, and a variation (individual difference) also occurs to the displacement.

By adopting the structure as in the present embodiment, the variation of the force with which the upper holding member 104 and the lower holding member 105 fix the metal diaphragm damper 9, which generates due to the variation (individual difference) of this displacement can be made small.

Embodiment 4

Next, a fourth embodiment of the present invention will be described.

The difference between the fourth embodiment and the first embodiment is that the recess end surface 115 of the pump housing 1 and a lower end portion 124 of the upper holding member 104 are in contact with each other, but the pump housing 1 and the lower holding member 105 are not in contact with each other. The parts except for this are the same as those in the first embodiment, and the described codes and numerals are all common to the first embodiment.

Figure 13:
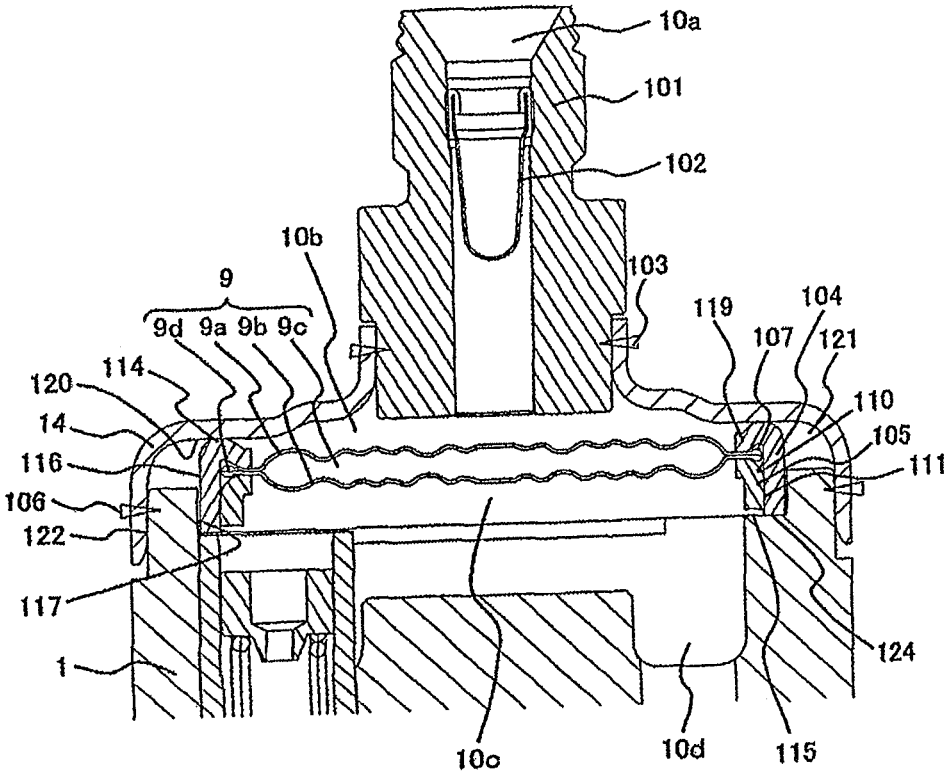
FIG. 13 is a vertical sectional view of a high pressure fuel supply pump according to a fourth embodiment in which the present invention is carried out, and an enlarged view of a periphery of a metal diaphragm damper 9 portion.

FIG. 13 is a vertical sectional view of a high pressure fuel supply pump in the present embodiment, and is an enlarged view of the metal diaphragm damper 9 portion for absorbing pressure pulsation.

The damper cover 14 and the upper holding member 104 are in contact with each other at the contact portion 114. Meanwhile, the recess end surface 115 of the pump housing 1 and the lower end portion 124 of the upper holding member 104 are in contact with each other.

According to the present structure, the metal diaphragm damper 9 is vertically sandwiched by only mutual press-fitting force of the upper holding member 104 and the lower holding member 105.

Accordingly, even if a variation occurs to the force for pressing the damper unit 118 by the damper cover 14 and the pump housing 1 due to thermal distortion or the like which occurs after welding, the variation does not change the force for sandwiching the metal diaphragm damper 9, and the metal diaphragm damper 9 can be prevented from being broken.

When the metal diaphragm damper 9 is broken, the pressure pulsation of the fuel in the intake pipe 28 exceeds the allowable value, which results in breakage, fuel leakage and the like of the intake pipe 28.

Further, when the relief valve housing 206 slips upward in the drawing by the high pressure fuel due to a certain error, the relief valve housing 206 and the upper holding member 104 contact each other at first, where the relief valve housing 206 is prevented from slipping off.

In this case, the force for sandwiching the metal diaphragm damper 9 does not change.

Summary of the above embodiments are as follows.

Embodiment 1

A high pressure fuel supply pump which has a intake passage sucking a fuel to a pressure chamber, and a discharge passage discharging the aforementioned fuel from the aforementioned pressure chamber, performs intake and discharge of the fuel by a plunger reciprocating in the aforementioned pressure chamber, includes a intake valve in the aforementioned intake passage and a discharge valve in the aforementioned discharge passage, respectively, includes a pressure pulsation reducing damper for reducing pressure pulsation by changing in volume by pressure pulsation of the fuel, in the aforementioned intake passage or a low pressure chamber communicating with the aforementioned intake passage, wherein the aforementioned pressure pulsation reducing damper is a metal diaphragm damper with two metal diaphragms welded at its peripheral edge portions and gas sealed therebetween, characterized in that the aforementioned metal diaphragm damper exists in a space formed by a body and a cover, the aforementioned cover has a projected portion projecting inside, and the aforementioned metal diaphragm damper is sandwiched and fixed by the projected portion and the aforementioned body.

Embodiment 2

The high pressure fuel supply pump according to embodiment 1, characterized in that the aforementioned projected portion has a annular projected portion with a part of it being omitted.

Embodiment 3

The high pressure fuel supply pump according to embodiment 1, or 2, characterized in that a pair of upper and lower holding members vertically sandwich the peripheral edge portion of the aforementioned metal diaphragm damper, whereby three of them (a pair of upper and lower holding members and metal diaphragm damper) are unitized as a damper unit in this state, the aforementioned projected portion of the aforementioned cover and the aforementioned upper holding member of the aforementioned damper unit contact each other, and the aforementioned damper unit is sandwiched by the aforementioned cover and the aforementioned body, whereby the aforementioned metal diaphragm damper is sandwiched and fixed, and a passage communicating with an inside and an outside is provided between the aforementioned cover and the aforementioned upper holding member to allow a space between the aforementioned metal diaphragm damper and the aforementioned cover to communicate with a space between the aforementioned metal diaphragm damper and the aforementioned body.

Embodiment 4

A high pressure fuel supply pump which has a intake passage sucking a fuel to a pressure chamber, and a discharge passage discharging the aforementioned fuel from the aforementioned pressure chamber, performs intake and discharge of the fuel by a plunger reciprocating in the aforementioned pressure chamber, includes a intake valve in the aforementioned intake passage and a discharge valve in the aforementioned discharge passage, respectively, includes a pressure pulsation reducing damper for reducing pressure pulsation by changing in volume by pressure pulsation of the fuel, in the aforementioned intake passage or a low pressure chamber communicating with the aforementioned intake passage, wherein the aforementioned pressure pulsation reducing damper is a metal diaphragm damper with two metal diaphragms being welded at its peripheral edge portions and gas being sealed therebetween, characterized in that a pair of upper and lower holding members vertically sandwich the peripheral edge portion of the aforementioned metal diaphragm damper, whereby three of them (the pair of upper and lower holding members and metal diaphragm damper) are unitized as a damper unit in this state, the aforementioned damper unit is covered, and the aforementioned upper holding member of the aforementioned damper unit is contacted to press the aforementioned damper unit to a body of the high pressure fuel supply pump, a passage communicating with an inside and an outside is provided between the aforementioned cover and the aforementioned upper holding member to allow a space between the aforementioned metal diaphragm damper and the aforementioned cover to communicate with a space between the aforementioned metal diaphragm damper and the aforementioned body.

Embodiment 5

The high pressure fuel supply pump according to embodiments 3 and 4, characterized in that the aforementioned upper and lower holding members contact the peripheral edge portion of the aforementioned metal diaphragm damper over an entire circumference.

Embodiment 6

The high pressure fuel supply pump according to embodiments 3 and 4, characterized in that the aforementioned upper and lower holding members are fixed to each other by press-fitting at the peripheral portion at an outer side from the metal diaphragm damper to form the aforementioned damper unit.

Embodiment 7

The high pressure fuel supply pump according to embodiments 3 and 4, characterized in that a annular space is formed between the aforementioned upper and lower holding members, and a weld portion of the aforementioned metal diaphragm damper is housed in the space.

Embodiment 8

The high pressure fuel supply pump according to embodiments 3 to 4, characterized in that an outer periphery of one of the aforementioned upper and lower holding members forms a positioning surface in the diameter direction with the body.

Embodiment 9

The high pressure fuel supply pump according to embodiments 3 and 4, characterized in that the aforementioned upper and lower holding members are fixed to each other at the peripheral edge portion by welding to form the aforementioned damper unit.

Embodiment 10

The high pressure fuel supply pump according to embodiments 3 and 4, characterized in that the aforementioned upper holding member contacts the aforementioned cover, and the aforementioned lower holding member contacts the aforementioned body.

Embodiment 11

The high pressure fuel supply pump according to embodiments 3 and 4, including a relief passage connecting a high pressure portion downstream from the aforementioned discharge valve and a space formed by the aforementioned body and the aforementioned cover, and including, in the aforementioned relief passage, a limiting valve limiting a flow of a fuel to one direction into the space formed by the aforementioned body and the aforementioned cover from the high pressure portion downstream from the aforementioned discharge valve, characterized in that the aforementioned relief passage overlies on a region between the outer periphery of the aforementioned upper holding member and the inner periphery of the aforementioned lower holding member.

Embodiment 12

The high pressure fuel supply pump according to embodiments 3 and 4, characterized in that one of the aforementioned upper and lower holding members has a curl portion, one end of the other holding member faces the aforementioned curl portion to sandwich the aforementioned metal diaphragm.

Embodiment 13

The high pressure fuel supply pump according to embodiments 3 and 4, characterized in that diameters of a contact portion of the aforementioned upper holding member and the aforementioned metal diaphragm damper, and a contact portion of the aforementioned lower holding member and the aforementioned metal diaphragm are equal.

Embodiment 14

A device for reducing fuel pulsation in a high pressure fuel supply apparatus of an internal combustion engine in the high pressure fuel supply pump according to embodiments 3 and 4, characterized in that the aforementioned cover is formed into a cup shape, its open side annular end surface contacts on a annular surface of a damper housing chamber peripheral edge of the aforementioned body, both of them are joined by welding in an entire outer circumference of the abutting surface portion.

Embodiment 15

A device for reducing fuel pulsation in a high pressure fuel supply apparatus of an internal combustion engine, wherein a damper housing chamber provided with an inlet port and an outlet port for a fuel is included, the aforementioned damper housing chamber is configured by a body forming a part of the aforementioned fuel passage and a cover fixed to the body, the aforementioned damper housed in the aforementioned damper housing chamber is configured by two metal diaphragms with their outer peripheral edges being joined to each other, gas is sealed in a space between both the diaphragms, the damper is held by a pair of upper and lower holders to be fitted to between the aforementioned body and the aforementioned cover, and both the aforementioned two metal diaphragms are exposed to a flow of the fuel in the aforementioned damper housing chamber, characterized in that the aforementioned pair of holders are fixed to each other in a state in which the holders hold the aforementioned diaphragm, and as a result, the aforementioned pair of holders and the aforementioned diaphragm form a unit.

Embodiment 16

The device for reducing fuel pulsation in a high pressure fuel supply apparatus of an internal combustion engine according to embodiment 15, characterized in that the aforementioned damper housing chamber is connected to a fuel pipe connected to a high pressure fuel supply pump of the high pressure fuel supply apparatus of the internal combustion engine independently from the aforementioned high pressure fuel supply pump.

Embodiment 17

The device for reducing fuel pulsation in a high pressure fuel supply apparatus of an internal combustion engine according to embodiment 15, characterized in that the aforementioned body of the aforementioned damper housing chamber is formed by a pump body of a high pressure fuel supply pump in the high pressure fuel supply apparatus of the internal combustion engine, and the aforementioned cover is fixed to the aforementioned pump body.

Embodiment 18

The device for reducing fuel pulsation in a high pressure fuel supply apparatus of an internal combustion engine according to any one of embodiments 15 to 17, characterized in that the aforementioned pair of holders are fixed to each other by press-fitting.

Embodiment 19

The device for reducing fuel pulsation in a high pressure fuel supply apparatus of an internal combustion engine according to embodiment 17, characterized in that a fixing force for fixing the aforementioned cover to the aforementioned body acts on an abutting portion of the aforementioned cover and one holder out of the aforementioned pair of holders, and the aforementioned body abutting on the other holder out of the aforementioned pair of holders via the aforementioned press-fit portions of both the aforementioned holders.

Embodiment 20

The device for reducing fuel pulsation in a high pressure fuel supply apparatus of an internal combustion engine according to claim 19, characterized in that the aforementioned cover is formed into a cup shape, its open side annular end surface abuts on an annular surface of the aforementioned damper housing chamber peripheral edge of the aforementioned body, and both of them are joined to each other by welding in an entire outer circumference of the abutting surface portion.

The problems to be solved by the above described embodiments are as follows.

1) When the prior art adopts the structure of pressing and fixing the annular flat plate portion of the metal diaphragm damper over the entire circumference while spreading a fuel over both the surfaces of the metal diaphragm damper, there is the problem that the weight of the mechanism for reducing pressure pulsation is large since the cover is configured by a thick member.
2) If a fuel cannot be spread over both the surfaces of the metal diaphragm damper, pressure pulsation which occurs to the fuel cannot be sufficiently absorbed.
3) Unless the structure of pressing and fixing the annular flat plate portion of the metal diaphragm damper over the entire circumference is adopted, stress of an allowable value or more occurs to the weld portion, and the weld portion is broken.

One object of the embodiments is 1) to adopt the structure of pressing and fixing the annular flat plate portion of the metal diaphragm damper over the entire circumference while spreading a fuel over both the surfaces of the metal diaphragm damper, and decrease the weight of the mechanism for reducing pressure pulsation.

In order to attain this object, in the present embodiment, in order to solve the above described problems basically, in the present invention, by vertically sandwiching the peripheral edge portion of the aforementioned metal diaphragm damper with a pair of upper and lower holding members, three of them (the pair of upper and lower holding members and metal diaphragm damper) are unitized as a damper unit in this state, the aforementioned damper unit is covered, the aforementioned upper holding member of the aforementioned damper unit is contacted to press the aforementioned damper unit to the body of the high pressure fuel supply pump, a passage communicating an inside and an outside is provided between the aforementioned cover and the aforementioned upper holding member to allow a space between the aforementioned metal diaphragm damper and the aforementioned cover to communicate with a space between the aforementioned metal diaphragm damper and the aforementioned body.

The upper and lower holding members contact the peripheral edge portion of the aforementioned metal diaphragm damper over the entire circumference.

The cover is formed into a cup shape, its open side annular end surface abuts on a annular surface of the damper housing chamber peripheral edge of the body, and both of them are joined by welding in the entire outer circumference of the abutting surface portion.

In this manner, the structure of pressing and fixing the annular flat plate portion of the metal diaphragm damper over the entire circumference while spreading the fuel over both surfaces of the metal diaphragm damper is adopted, and the weight of the mechanism for reducing pressure pulsation is decreased.

Further, the holding members are fixed to each other by press-fitting on the peripheral edge portion at an outer side from the metal diaphragm damper to form the aforementioned damper unit.

Thereby, at the time of the operation of installing the metal diaphragm damper in the high pressure fuel supply pump, the number of the components installed and fixed into the body at the same time is reduced, and component omission and assembly error can be prevented.

INDUSTRIAL APPLICABILITY

The present invention can be applied to various fuel conveying systems as a mechanism for reducing pressure pulsation which restrains pulsation of a fuel. The present invention is especially preferable when used as a mechanism for reducing fuel pulsation mounted to a low pressure fuel passage of a high pressure fuel supply system which pressurizes gasoline and discharge the gasoline to an injector. Further, the present invention can be integrally mounted to a high pressure fuel supply pump as in the embodiments.

The above description is made on the embodiments, but the present invention is not limited to it, and it is obvious to a person skilled in the art that various changes and modifications can be made within the spirit of the present invention and the scope of the accompanying claims.

The invention claimed is:

1. A high-pressure fuel supply pump comprising:

a metal damper including a pair of disk-shaped metal diaphragms forming therein a sealed chamber, a damper chamber containing therein the metal damper, a damper cover defining part of the damper chamber, a pressurizing chamber for pressurizing a fuel, a low pressure fuel path for supplying the fuel from the damper chamber into the pressurizing chamber, a first holding member contacting an outer periphery of the metal damper, and a second holding member fitted to the first holding member so that the first and second holding members are fixed to each other, while the metal damper is clamped between the first and second holding members, wherein the metal damper and the first and second holding members form a united damper unit contained in the damper chamber independently of the damper cover.

2. The high-pressure fuel supply pump according to claim 1, wherein outer surfaces of the disk-shaped metal diaphragms are arranged in the damper chamber to face to the fuel flowing in the damper chamber toward the pressurizing chamber from a fuel inlet joint attached to a body of the high-pressure fuel supply pump.

3. The high-pressure fuel supply pump according to claim 1, wherein the first and second holding members have respective annular uninterrupted surfaces contacting respective outer surfaces of the disk-shaped metal diaphragms so that the metal damper is clamped between the annular uninterrupted surfaces, and the first and second holding members are fitted to each other at a radially outer side with respect to the annular uninterrupted surfaces.

4. The high-pressure fuel supply pump according to claim 1, further comprising a cover member including an inner wall surface forming partially a wall surface of the damper chamber and pressed against an outer surface of one of the first and second holding members, and an end of the other one of the first and second holding members is pressed against a wall surface of the damper chamber at a side opposite to the cover member through the first and second holding members so that the united damper unit is attached to the damper chamber.

5. The high-pressure fuel supply pump according to claim 4, wherein a part of the inner wall surface of the cover member is prevented from being pressed against the outer surface of the one of the first and second holding members so that a clearance is formed over the part of the inner wall surface to enable the fuel to flow through the clearance.

6. The high-pressure fuel supply pump according to claim 4, wherein the cover member has a fuel inlet port facing to one of the disk-shaped metal diaphragms facing to the cover member, the damper chamber has a fuel output port at a bottom surface of the damper chamber, and the other one of the disk-shaped metal diaphragms facing to the bottom surface of the damper chamber faces to the fuel outlet port.

7. The high-pressure fuel supply pump according to claim 4, wherein the cover member is fitted to a radially outer side of the damper chamber and presses the other one of the first and second holding members against a bottom surface of the damper chamber.

8. The high-pressure fuel supply pump according to claim 1, wherein the first and second holding members are fixed to each other by a press fit therebetween so that the pair of disk-shaped metal diaphragms is clamped between the first and second holding members.

9. The high-pressure fuel supply pump according to claim 1, wherein the metal damper contained in the damper chamber has surfaces over which fuel in the damper chamber spreads.

* * * * *